United States Patent [19]

Faulstich

[11] 3,970,207

[45] July 20, 1976

[54] PLASTIC STOPPER FOR WINE BOTTLE OR THE LIKE

[75] Inventor: George W. Faulstich, San Carlos, Calif.

[73] Assignee: Three Sisters Ranch Enterprises, San Carlos, Calif.

[22] Filed: May 27, 1975

[21] Appl. No.: 580,545

[52] U.S. Cl. ..... 215/296; 215/302

[51] Int. Cl.[2] ..... B65D 39/00

[58] Field of Search ..... 215/296, 297, 302; 220/284

[56] References Cited

FOREIGN PATENTS OR APPLICATIONS

| | | | |
|---|---|---|---|
| 1,106,988 | 7/1955 | France | 215/302 |
| 349,500 | 11/1960 | Switzerland | 215/296 |
| 764,794 | 1/1957 | United Kingdom | 215/297 |

*Primary Examiner*—Donald F. Norton
*Attorney, Agent, or Firm*—Julian Caplan

[57] ABSTRACT

A plastic stopper is used for small-diameter bottle necks such as are conventionally closed by corks. A top disk is annular in that a central hole is formed and below the disk is a pocket having an inside diameter coinciding with the central hole. The pocket is closed at the bottom. The pocket is dimensioned to receive a standard corkscrew with a tight enough grip to permit the stopper to be drawn. The disk also has a peripheral depending skirt having an outside diameter such that it fits tightly in the bottle neck. The lower outer edge of the skirt is tapered to facilitate seating. An annular space below the disk between the skirt and the pocket affords flexibility to the stopper for seating and pulling and also can be partially filled with liquid to reduce the amount of air in the headspace of the bottle.

2 Claims, 3 Drawing Figures

PLASTIC STOPPER FOR WINE BOTTLE OR THE LIKE

This invention relates to a new and improved plastic stopper for wine bottles or the like. A principal feature of the present invention is that the plastic stopper replaces corks which conventionally have been used with wine bottles. Cork is becoming increasingly expensive; and further, tends to dry, thereby permitting air to enter the bottle and cause deterioration of the contents. The present invention is of a plastic material which is readily available and inexpensive. Furthermore, it is not necessary to keep the plastic wet in order to prevent air entering the bottle. Hence bottles may be stored neck up, a practice which is undesirable with standard wine bottle corks. The cork may be colored and ornamented in such manner that it resembles standard cork.

A feature of the invention is the provision of a central pocket in the stopper having an inside diameter slightly smaller than that of a standard corkscrew. Hence a corkscrew may be used to pull the stopper from a bottle neck. A solid stopper is undesirable in that considerable force is required to insert the corkscrew into the plastic material and also the insertion of the corkscrew causes an outward pressure within the plastic causing the stopper to tend to stick within the bottleneck.

One of the desirable features of the present invention is the fact that a standard corkscrew may be used and even the sound of the stopper as it is pulled from the bottleneck resembles that of the pulling of a cork. This feature is particularly desirable where the corks are pulled in restaurants, the patrons enjoying the sound of the waiter or wine steward opening the vintage.

Another feature of the invention is the fact that there is considerable flexibility in the stopper which assures tight engagement of the outside of the stopper in the neck of the bottle yet the stopper is compressible enough so that it will flex and permit the stopper to be pulled.

Another feature of the invention is the fact that the stopper may be inserted by use of standard corking machinery used in wineries. In addition, the stopper may be removed with a standard corkscrew. A pocket for the corkscrew is provided and this pocket is slightly smaller in diameter than the corkscrew but the walls of the pocket may flex so that a tight grip on the corkscrew is obtained permitting the stopper to be pulled in conventional manner.

Other objects of the present invention will become apparent upon reading the following specification and referring to the accompanying drawings in which similar characters of reference represent corresponding parts in each of the several views.

Figure 2:
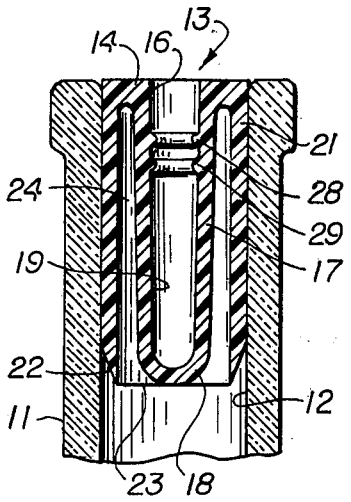
FIG. 2 is a vertical sectional view of the structure of FIG. 1 with the stopper inserted.
Figure 1:
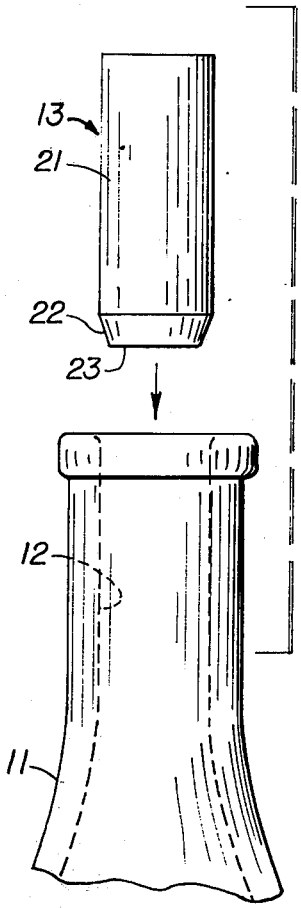
FIG. 1 is a side elevational view of a stopper in accordance with the present invention and a bottleneck with which it is used.

The present invention is used with a bottleneck 11 of conventional construction having an inside diameter 12 of the type used in standard wine bottles. Stopper 13 has an external dimension so as to fit tightly within the neck 11 and has a length about equal to that of standard wine corks.

Stopper 13 has an annular disk 14 at its upper end formed with a central hole 16. Below disk 14 is a pocket 17 the inside diameter 19 of which tapers downwardly so that at the top pocket 16 coincides with the diameter of hole 16 and is smaller at the lower end where it merges with rounded bottom 18. A standard corkscrew 26 fits tightly inside pocket 17.

Depending from the periphery of disk 14 is an outer skirt 21 the outside diameter of which is such as to fit tightly within the inside diameter 12 of neck 11. At the bottom end of skirt 21 is an external downward taper 22 which facilitates seating the stopper 13 in the neck 11 by standard corking equipment. The bottom edge 23 of skirt 21 preferably coincides with the bottom surface of bottom 18 of pocket 17 and the total length of the cork, as has been stated, is such that it will fit tightly within the neck 11 and grip the neck with sufficient frictional force to prevent unintentional dislodgement of the stopper.

Figure 3:
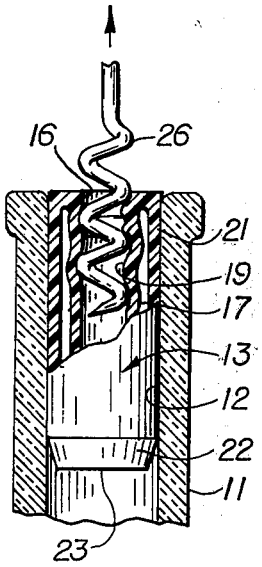
FIG. 3 is a view similar to FIG. 2 showing a corkscrew being used to pull the stopper.

As is shown, there is an annular space 24 between the outside of pocket 17 and the inside of skirt 21 and this space permits flexing of the pocket 17 outwardly, when the corkscrew 26 is being inserted as shown in FIG. 3, and also permits the skirt 21 to flex inwardly while the cork is being pulled so as to slide over the inner wall 12 of the neck 11. To facilitate gripping of the inner wall of pocket 17 with the corkscrew 26, a plurality of ridges 28, 29 may be formed on the interior wall of pocket 17.

In use, the stopper 13 is installed with the taper 22 fitting inside the top of the neck 11 and then standard corking machinery pushes the cork into the neck so that it seats as shown in FIG. 2. When thus seated, the neck 11 is airtight. Since there is no tendency of the stopper 13 to dry out (as is true when corks are not wet by the contents of the bottle), it is not necessary to store the bottles neck horizontal or neck downward, as is a proved practice in conventional wine bottles.

When the stopper 13 is to be drawn, the corkscrew 26 is inserted through hole 16 and causes the pocket 17 to deform as best shown in FIG. 3. The ridges 28, 29 grip the corkscrew 26 so that when it is pulled the stopper 13 follows the corkscrew. If only part of the contents of the bottle are consumed, the stopper 13 may be manually reinserted by the consumer and pulled again if required.

What is claimed is:

1. A plastic stopper for a standard bottleneck adapted to be pulled with a standard cork screw comprising a top disc with a central hole, a pocket-forming portion below said disc having an inside diameter at the top coinciding with said hole, the interior of said pocket-forming portion being formed with a plurality of ridges, each ridge being transverse to the axis of said stopper to facilitate said cork screw being tightly received in said pocket, the interior of said pocket-forming portion tapering downwardly, said pocket-forming portion being air and liquid-tight at the bottom, and a peripheral smooth, exterior skirt below said disc having a substantially constant outside diameter such as to fit tightly within said bottleneck and of a length about equal to that of said pocket-forming portion, there being an annular space between the exterior of said pocket-forming portion and the interior of said skirt, said central hole and the interior of said pocketforming portion being dimensioned slightly less than the exterior of said standard cork screw, the bottom of said pocket-forming portion being rounded.

2. A stopper according to claim 1 in which the bottom of said skirt is formed with a downward-inward taper.

* * * * *